US010457509B2

(12) United States Patent
Kuriki

(10) Patent No.: US 10,457,509 B2
(45) Date of Patent: Oct. 29, 2019

(54) CARD TRANSPORT DEVICE

(71) Applicant: Brother Kogyo Kabushiki Kaisha, Nagoya (JP)

(72) Inventor: Yuichiro Kuriki, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/926,039

(22) Filed: Mar. 20, 2018

(65) Prior Publication Data

US 2018/0305147 A1 Oct. 25, 2018

(30) Foreign Application Priority Data

Apr. 25, 2017 (JP) ..... 2017-086568

(51) Int. Cl.
*B65H 3/34* (2006.01)
*B65H 3/52* (2006.01)
(Continued)

(52) U.S. Cl.
CPC ..... *B65H 3/34* (2013.01); *B65H 3/0676* (2013.01); *B65H 3/0684* (2013.01); *B65H 3/52* (2013.01); *B65H 3/5215* (2013.01); *B65H 3/5223* (2013.01); *B65H 3/565* (2013.01); *B65H 2405/1112* (2013.01);
(Continued)

(58) Field of Classification Search
CPC ..... B65H 1/00; B65H 1/04; B65H 3/0684; B65H 3/34; B65H 3/52; B65H 3/5215; B65H 3/5223; B65H 3/54; B65H 3/56; B65H 3/565; B65H 2405/111; B65H 2405/1112; B65H 2405/1118; B65H 2405/1136; B65H 2405/1412; B65H 2511/11; B65H 2405/13; B65H 2701/1914
See application file for complete search history.

(56) References Cited

U.S. PATENT DOCUMENTS 5,046,714 A * 9/1991 Hwang ..... B65H 1/04 271/127
2005/0196216 A1* 9/2005 Tanahashi ..... B65H 3/0684 400/625

(Continued)

FOREIGN PATENT DOCUMENTS

JP H05-170355 A 7/1993
JP 3628602 B2 3/2005

*Primary Examiner* — Prasad V Gokhale
(74) *Attorney, Agent, or Firm* — Burr & Brown, PLLC

(57) ABSTRACT

A card transport device transports one or more cards while reducing failures of its feed unit in feeding the cards. A card transport device includes a support surface that supports one or more cards thereon, a feed unit facing the support surface for feeding the one or more chards, a separator located downstream from the feed unit in a transport direction, a slope connected to a downstream support end of the support surface in the transport direction and extending obliquely upward downstream in the transport direction toward the separator, and a restrictor located on the support surface. The restrictor restricts a position of an upstream end of a particular card directly supported on the support surface, out of the one or more cards, thereby positioning a downstream end of the particular card to be downstream from the feed unit in the transport direction.

17 Claims, 8 Drawing Sheets

(51) Int. Cl.
*B65H 3/06* (2006.01)
*B65H 3/56* (2006.01)

(52) U.S. Cl.
CPC ..... *B65H 2405/1118* (2013.01); *B65H 2405/1136* (2013.01); *B65H 2511/11* (2013.01); *B65H 2701/1914* (2013.01)

(56) References Cited

U.S. PATENT DOCUMENTS

2007/0296138 A1* 12/2007 Su ..... B65H 1/04
271/109
2011/0156339 A1* 6/2011 Nakano ..... B65H 1/266
271/4.11
2014/0103597 A1* 4/2014 Kotaka ..... B65H 31/22
271/3.14
2015/0084263 A1* 3/2015 Kanzawa ..... B65H 1/14
271/3.2

* cited by examiner

CARD TRANSPORT DEVICE

CROSS-REFERENCE TO RELATED APPLICATION

This application claims priority from Japanese Patent Application No. 2017-086568 filed on Apr. 25, 2017, the content of which is incorporated herein by reference in its entirety.

TECHNICAL FIELD

Aspects of the disclosure relate to a card transport device.

BACKGROUND

A known sheet transport device includes a sheet feeding tray, a pick-up roller, a separation roller, a friction pad, and a separation wall.

The sheet feeding tray has an upper surface serving as a support surface for supporting sheets. The pick-up roller faces the support surface. The pick-up roller feeds sheets supported on the support surface downstream in a transport direction along the separation wall. The separation wall has a slope extending obliquely upward downstream in the transport direction toward the separation roller and the friction pad. The separation roller and the friction pad separate multiple sheets fed by the pick-up roller from one another, and transport each separated sheet downstream in the transport direction.

SUMMARY

The above known sheet transport device may feed a card supported on the support surface. A card is stiffer and smaller than a typical sheet. When a plurality of cards supported on the support surface are sequentially transported, a card directly supported on the support surface is likely to slide back along the slope of the separation wall upstream in the transport direction by its weight, causing the pick-up roller to fail to feed the card.

In response to the above issue, one or more aspects of the disclosure are directed to a card transport device that transports one or more cards supported on a support surface while reducing failures of its feed unit in feeding the cards.

A card transport device according to one or more aspects of the disclosure includes a support surface that supports one or more cards, a feed unit facing the support surface for feeding the one or more cards supported on the support surface downstream in the transport direction along a transport path, a separator located downstream from the feed unit in the transport direction for transporting the cards fed by the feed unit downstream in the transport direction while separating the cards from one another, a slope connected to a downstream support end of the support surface in the transport direction and extending obliquely upward downstream in the transport direction toward the separator, and a restrictor located on the support surface. The restrictor restricts a position of an upstream end in the transport direction of a particular card directly supported on the support surface, out of the one or more cards, thereby positioning a downstream end of the particular card to be downstream from the feed unit in the transport direction.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

First and second embodiments of the disclosure will now be described with reference to the drawings.

First Embodiment

Figure 1:
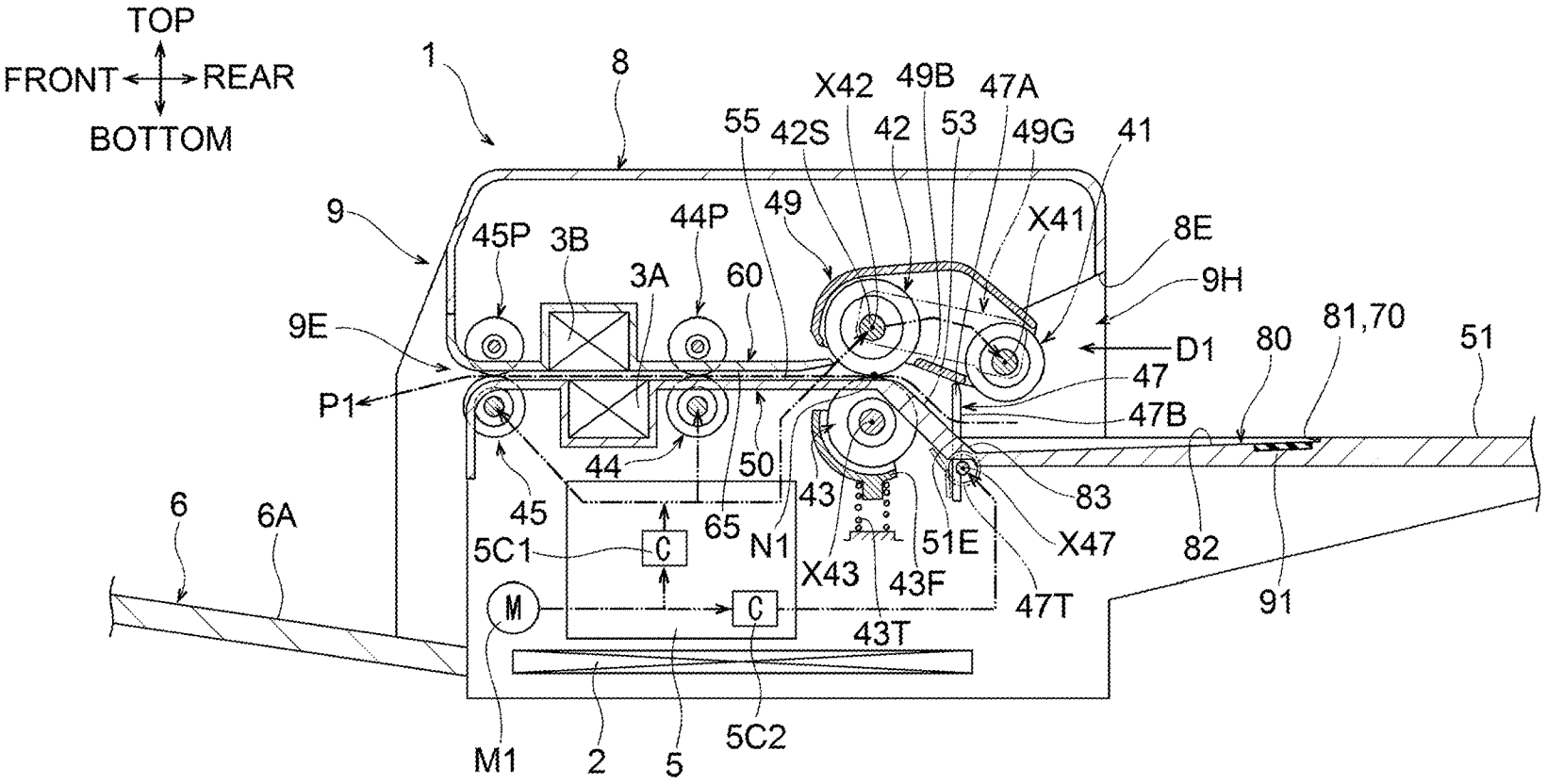
FIG. 1 is a schematic cross-sectional view of an image reader according to a first embodiment.

As shown in FIG. 1, an image reader 1 according to a first embodiment is a card transport device according to one embodiment of the disclosure. In FIG. 1, one end of the image reader 1 having a discharge tray 6 is the front, and one side of the image reader 1 on the left when viewed in the direction facing the discharge tray 6, or the far side in FIG. 1, is the left. The front, rear, left, right, up, and down shown in FIG. 2 and subsequent drawings are the directions in FIG. 1. The components of the image reader 1 will be described with reference to FIG. 1 and other drawings.

Overall Structure

As shown in FIG. 1, the image reader 1 includes a housing 9. The housing 9 is substantially a box with a plurality of exterior covers including an upper cover 8. The housing 9 also includes an internal frame (not shown), a support 50, and a guide 60.

The support 50 has a front portion assembled to the internal frame (not shown) in the housing 9, and a rear portion protruding rearward from the rear surface of the housing 9. The guide 60 is assembled to the internal frame (not shown) in the housing 9, and located above to face the front portion of the support 50. The support 50 and the guide 60 are substantially flat plates extending in the front-rear direction and the left-right direction.

The upper cover 8 covers the upper surface of the housing 9 and bends at the rear end of the housing 9 down to its rear end 8E. The rear end 8E of the upper cover 8 is located above and widely apart from the rear portion of the support 50 protruding rearward from the rear surface of the housing 9. An inlet 9H is formed between the rear end 8E of the upper cover 8 and the rear portion of the support 50 protruding rearward from the rear surface of the housing 9.

The front end of the support 50 and the front end of the guide 60 are exposed on the front surface of the housing 9. An outlet 9E is formed between the front end of the support 50 and the front end of the guide 60. The rear end of the discharge tray 6 is connected to a portion of the front surface of the housing 9 located below and apart from the outlet 9E. The discharge tray 6 is a substantially flat plate extending from the rear end to the front. The discharge tray 6 has an upper surface serving as a discharge surface 6A.

The support 50 and the guide 60 define a transport path P1, which extends from the inlet 9H to the outlet 9E in the housing 9. The direction and the shape of the transport path P1 are mere examples. In the present embodiment, a transport direction D1 is the frontward direction, or the direction from the inlet 9H to the outlet 9E. The width direction perpendicular to the transport direction D1 is the left-right direction.

More specifically, the support 50 includes a support surface 51, a slope 53, and a transport surface 55.

Figure 2:
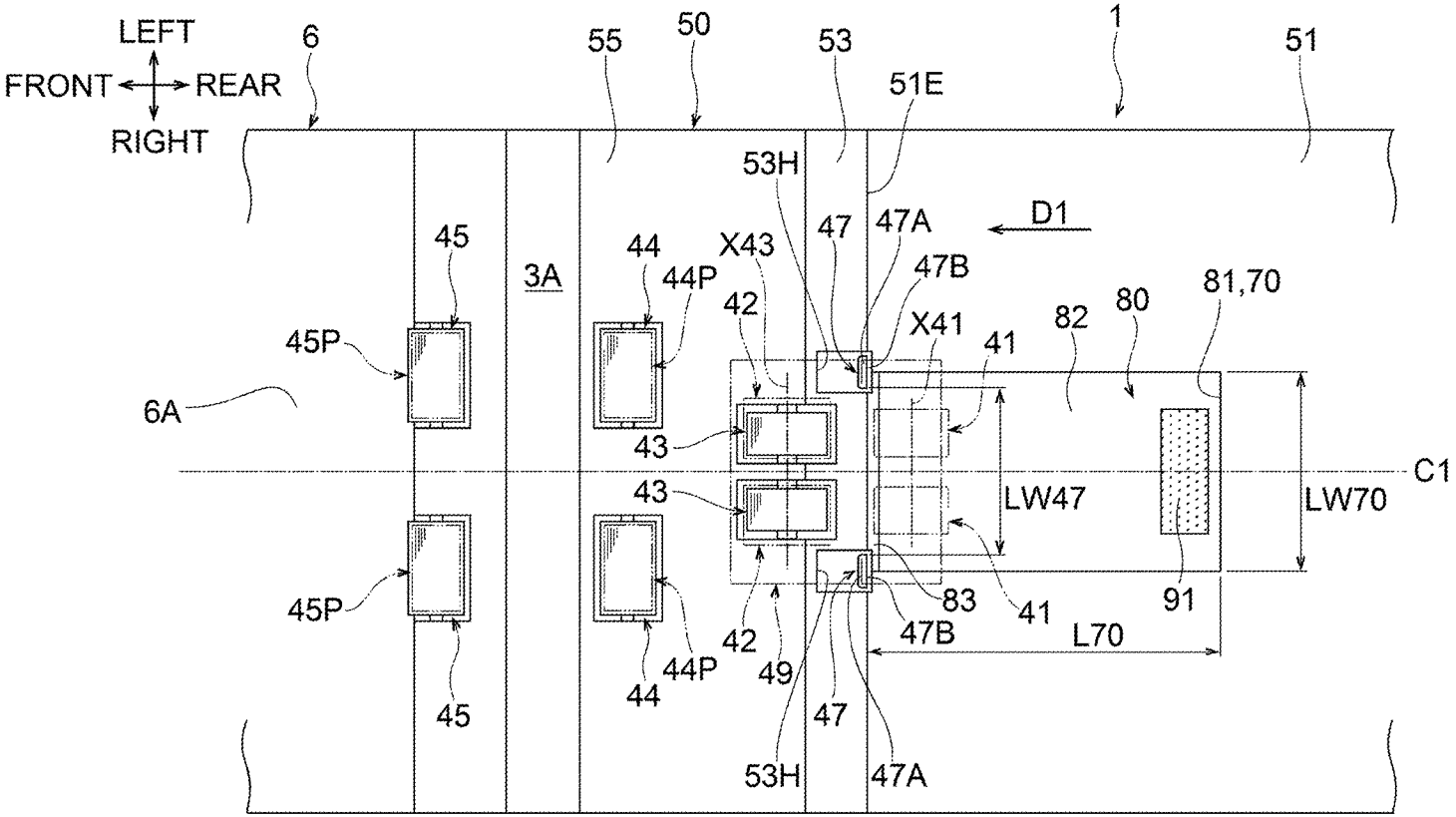
FIG. 2 is a schematic partial top view of the image reader according to the first embodiment, mainly showing a support surface, a slope, and a transport surface.

As shown in FIGS. 1 and 2, the support surface 51 is a flat surface including an upper surface of the rear portion of the support 50 protruding rearward from the rear surface of the housing 9 and substantially horizontally extending downstream in the transport direction D1 through the inlet 9H. The support surface 51 has a support end 51E downstream in the transport direction D1 located between the inlet 9H and a middle position in the housing 9 in the front-rear direction.

As shown in FIGS. 3 to 9, the support surface 51 selectively supports sheets SH and cards CA. In the example shown in FIGS. 3 and 4, the support surface 51 supports the sheets SH, such as paper sheets or overhead projector (OHP) sheets. In the example shown in FIGS. 5 to 9, the support surface 51 supports the cards CA. The cards CA are stiffer and smaller than paper sheets or OHP sheets. Examples of the cards CA include cash cards, membership cards, and driver's licenses. In the present embodiment, the support surface 51 is designed to support the cards CA placed in portrait orientation, or with their long sides extending in the transport direction D1.

In the present embodiment, the cards CA have a standardized size specified by the ID-1 format defined in International Organization for Standardization (ISO)/International Electrotechnical Commission (IEC) 7810. The cards CA have a thickness defined for plastic banking cards in the additional regulations of ISO/IEC.

More specifically, the cards CA each have a standardized long side of 85.60 mm, a standardized short side of 53.98 mm, and a standardized thickness of 0.76 mm. These dimensions are mere examples, and appropriately determined in accordance with the standardized size of a card readable by the image reader 1.

As shown in FIGS. 1 and 2, the lower end of the slope 53 connects to the support end 51E of the support surface 51. The slope 53 is a flat surface extending obliquely upward from the lower end to the upper end downstream in the transport direction D1. The slope 53 defines the bottom of the transport path P1 extending obliquely upward from the support end 51E.

The rear end of the transport surface 55 connects to the upper end of the slope 53. The transport surface 55 is a flat surface extending substantially horizontally from the rear end to the outlet 9E downstream in the transport direction D1. The transport surface 55 is on the level raised from the support surface 51 to have the level difference between the upper end and the lower end of the slope 53. The transport surface 55 defines the bottom of the transport path P1 extending substantially horizontally to the outlet 9E.

The center line C1 shown in FIG. 2 is a straight line passing through the center of the support surface 51, the slope 53, and the transport surface 55 in the width direction. FIG. 1 is a cross-sectional view taken along the center line C1 in FIG. 2.

In the present embodiment, the support 50 is a single unit but may include a plurality of parts. For example, the support 50 may include a feed tray protruding rearward from the housing 9, and a lower chute in the housing 9. The upper surface of the feed tray and the upper surface of a rear end portion of the lower chute may serve as the support surface 51.

As shown in FIG. 1, the guide 60 has a guide surface 65. The guide surface 65 has its rear end apart downstream from the rear end of the transport surface 55 in the transport direction D1. The guide surface 65 is a flat surface located above to face the transport surface 55, and extends substantially horizontally from the rear end of the guide surface 65 to the outlet 9E downstream in the transport direction D1. The guide surface 65 defines the top of the transport path P1 extending substantially horizontally to the outlet 9E.

The image reader 1 includes a controller 2, a motor M1, and a transmission mechanism 5, which are contained in the housing 9. The image reader 1 includes feed rollers 41, stoppers 47, separation rollers 42, retard rollers 43, transport rollers 44, transport pinch rollers 44P, reading sensors 3A and 3B, discharge rollers 45, and discharge pinch rollers 45P, which are arranged along the transport path P1 in the housing 9.

The feed rollers 41 each are an example of a feed unit according to an aspect of the disclosure. The separation rollers 42 and the retard rollers 43 each are an example of a separator according to an aspect of the disclosure. The reading sensors 3A and 3B each are an example of a reader according to an aspect of the disclosure.

The controller 2 controls the motor M1 and the reading sensors 3A and 3B during an image reading operation. The controller 2 receives input commands from users through an input/output panel (not shown) or displays the operation state or the settings of the image reader 1. The motor M1 rotates forward and backward under the control of the controller 2 to generate a driving force. The transmission mechanism 5 includes one-way clutches 5C1 and 5C2, and a plurality of gears, pulleys, and belts, which are not shown.

When the motor M1 rotates forward, the transmission mechanism 5 has the one-way clutch 5C1 engaged and the one-way clutch 5C2 disengaged. Thus, the transmission mechanism 5 transmits a driving force to the feed rollers 41, the separation rollers 42, the transport rollers 44, and the discharge rollers 45 via the one-way clutch 5C1.

When the motor M1 rotates backward, the transmission mechanism 5 has the one-way clutch 5C1 disengaged and the one-way clutch 5C2 engaged. Thus, the transmission mechanism 5 transmits a driving force to the stoppers 47 via the one-way clutch 5C2.

The housing 9 contains a rotation shaft 42S and a holder 49. The rotation shaft 42S is supported by the internal frame (not shown) in a manner rotatable about a second axis X42. The second axis X42 extends in the left-right direction above and apart from the transport surface 55 and slightly downstream in the transport direction D1 from the connection between the transport surface 55 and the slope 53. The separation rollers 42 are attached to the rotation shaft 42S in a manner rotatable together.

The holder 49 is supported by the rotation shaft 42S in a manner swingable about the second axis X42. The holder 49 protrudes rearward away from the rotation shaft 42S over the slope 53.

The holder 49 has a rear end at which the feed rollers 41 are held in a manner rotatable about a first axis X41. The first axis X41 extends in the left-right direction above and apart from the support surface 51 and upstream in the transport direction D1 from the support end 51E of the support surface 51. The first axis X41 and the second axis X42 are parallel to each other. More specifically, the feed rollers 41 are located above to face the support surface 51.

The rotation shaft 42S and the feed rollers 41 are connected to each other by a transmission gear train 49G in the holder 49. The transmission mechanism 5 transmits a driving force to the separation rollers 42 via the engaged one-way clutch 5C1 and the rotation shaft 42S. In this state, the transmission mechanism 5 also transmits a driving force to the feed rollers 41 via the rotation shaft 42S and the transmission gear train 49G.

A bottom wall 49B of the holder 49 is a substantially flat plate extending between the feed rollers 41 and the separation rollers 42. The lower surface of the bottom wall 49B is located above to face the slope 53 and extends obliquely upward downstream in the transport direction D1.

The retard rollers 43 are held by a retard roller holder 43F in a manner rotatable about a rotation axis X43 and located immediately below the separation rollers 42. A compression spring 43T is located between the lower surface of the retard roller holder 43F and the internal frame (not shown). The rotation axis X43 extends in the left-right direction below and apart from the transport surface 55. The outer circumferential surface of each retard roller 43 is partially exposed through the transport surface 55.

Each retard roller 43 is pressed against the corresponding separation roller 42 by the compression spring 43T into contact with the separation roller 42 at a nip portion N1. The nip portion N1 is slightly downstream in the transport direction D1 from the connection between the transport surface 55 and the slope 53. In other words, the slope 53 extends obliquely upward downstream in the transport direction D1 toward the nip portion N1 between the separation rollers 42 and the retard rollers 43.

A torque limiter (not shown) is placed between the retard rollers 43 and the retard roller holder 43F. The torque limiter stops rotation of the retard rollers 43 pressed against the separation rollers 42 when the torque acting on the retard rollers 43 is below or equal to a predetermined value. The torque limiter allows the retard rollers 43 to rotate when the torque acting on the retard rollers 43 exceeds the predetermined value.

As shown in FIG. 2, the feed rollers 41 are at two positions apart from each other in the left-right direction across the center line C1. The separation rollers 42 are arranged downstream from the feed rollers 41 in the transport direction D1 at two positions apart from each other in the left-right direction across the center line C1. The retard rollers 43 are arranged immediately below the separation rollers 42 at two positions apart from each other in the left-right direction across the center line C1.

The slope 53 has stopper openings 53H. The stopper openings 53H are at two positions apart from each other in the left-right direction across the center line C1. The stopper openings 53H are substantially rectangular holes extending over the support end 51E of the support surface 51 and through the support surface 51. The left stopper opening 53H is leftward from the left feed roller 41. The right stopper opening 53H is rightward from the right feed roller 41.

The stoppers 47 are at two positions corresponding to the two stopper openings 53H, and are apart from each other in the left-right direction across the center line C1.

Figure 3:
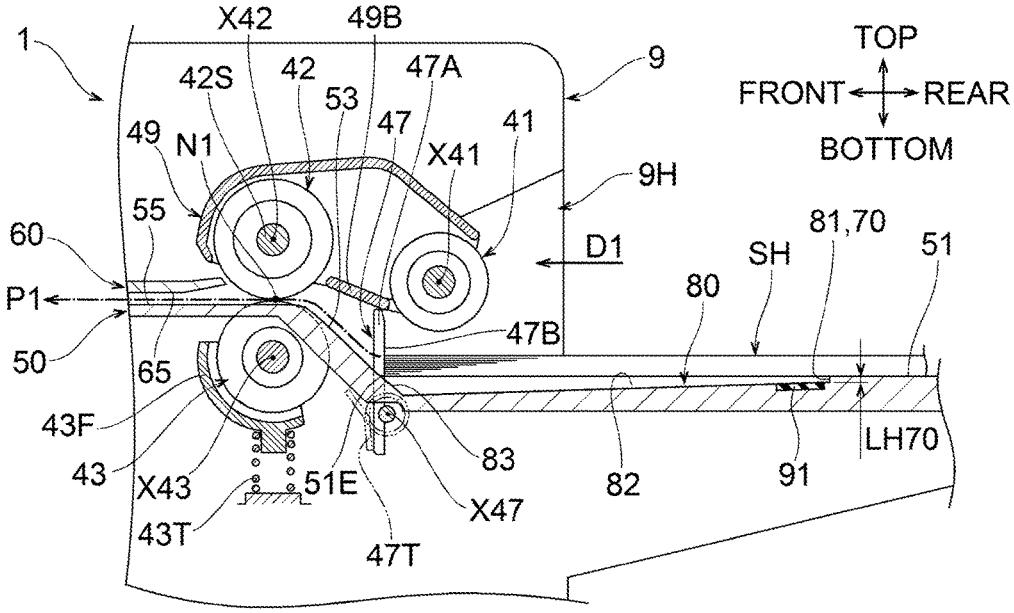
FIG. 3 is a schematic partial cross-sectional view of the image reader according to the first embodiment.
Figure 4:
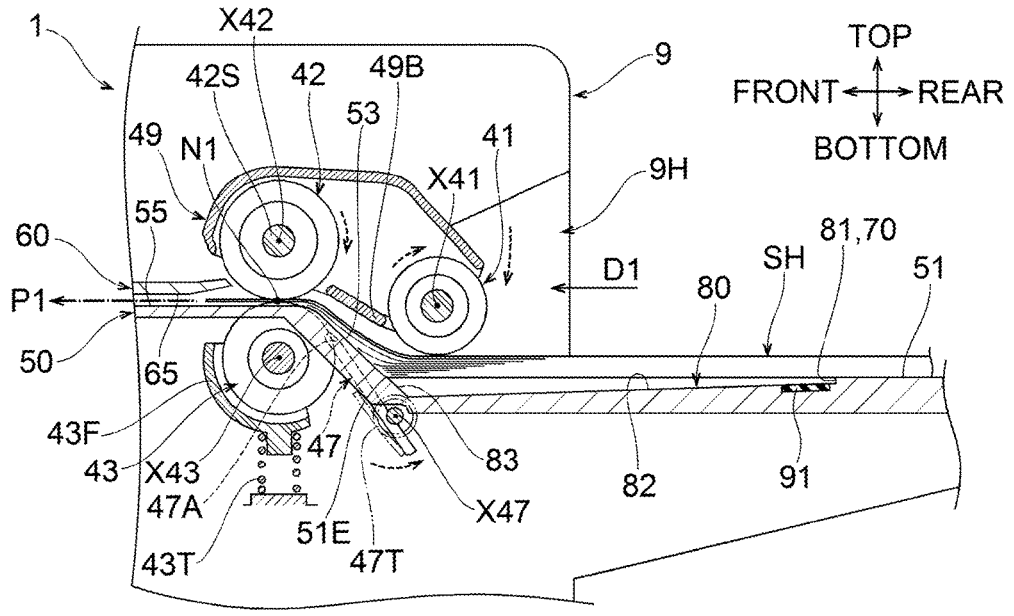
FIG. 4 is a schematic partial cross-sectional view of the image reader according to the first embodiment.

As shown in FIGS. 3 and 4, the stoppers 47 are supported by the internal frame (not shown) in a manner swingable about a swing axis X47. The swing axis X47 extends in the left-right direction below and apart from the support end 51E of the support surface 51. The stoppers 47 can swing about the swing axis X47 to move between a first position shown in FIGS. 1 to 3 and FIG. 5, and a second position shown in FIG. 4 and FIGS. 6 to 9.

The stoppers 47 at the first position as shown in FIG. 3 and other drawings extend upward from the swing axis X47 through the stopper openings 53H shown in FIG. 2 to cross the slope 53. In this state, distal ends 47A of the stoppers 47 are in contact with the bottom wall 49B of the holder 49 to move the holder 49 upward away from the support surface 51. The feed rollers 41 are thus held above and apart from the support surface 51. In this state, each stopper 47 has a stopper surface 47B facing upstream in the transport direction D1. The stopper surface 47B is a flat surface extending vertically, perpendicular to the support surface 51. The stopper surface 47B has a lower end substantially aligned with the support end 51E of the support surface 51. The stopper surface 47B has an upper end extending above the lowermost outer circumferential surface of the feed rollers 41.

As shown in FIG. 3, the stoppers 47 at the first position have the left and right stopper surfaces 47B that restrict the ends of the sheets SH when the sheets SH are placed by a user on the support surface 51 and inserted into the housing 9 through the inlet 9H.

Figure 5:
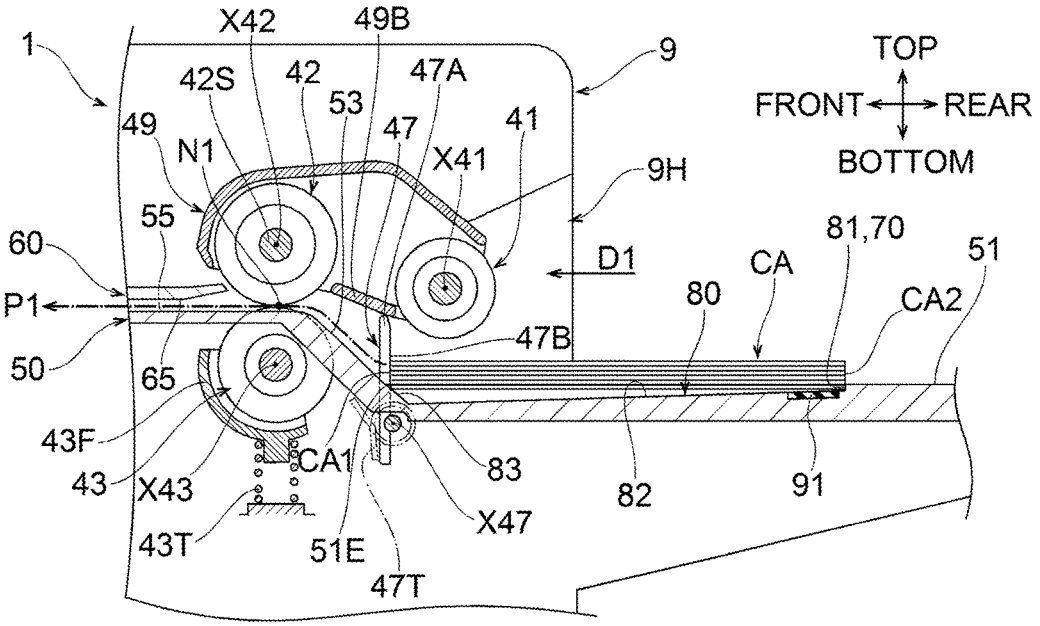
FIG. 5 is a schematic partial cross-sectional view of the image reader according to the first embodiment.

As shown in FIG. 2, the stoppers 47 at the first position are spaced from each other by a distance LW47, which is shorter than the standardized short side of the card CA supported on the support surface 51 in portrait orientation (53.98 mm in the present embodiment). As shown in FIG. 5, the stoppers 47 at the first position have the left and right stopper surfaces 47B that restrict a downstream first end CA1 of each card CA in the transport direction D1 inserted into the housing 9 through the inlet 9H when the card CA is placed by a user on the support surface 51 in portrait orientation.

The stoppers 47 at the second position shown in FIG. 4 and other drawings withdraw from the slope 53 when their entire parts including their distal ends 47A enter the stopper openings 53H. In this state, the stoppers 47 move down apart from the bottom wall 49B of the holder 49. Thus, the holder 49 swings toward the support surface 51, and the feed rollers 41 move toward the support surface 51.

As shown in FIG. 4, the stoppers 47 at the second position thus allow transportation of the sheets SH supported on the support surface 51. As shown in FIGS. 6 to 9, the stoppers 47 at the second position allow transportation of the cards CA supported on the support surface 51.

As shown in FIGS. 3 and 4 and other drawings, torsion springs 47T are located around the swing axis X47. Each torsion spring 47T has one end engaged with the support 50, and the other end engaged with the lower end of the corresponding stopper 47. The stoppers 47 are urged by the torsion springs 47T toward the second position shown in FIG. 4 and FIGS. 6 to 9.

When the motor M1 rotates forward, the one-way clutch 5C2 of the transmission mechanism 5 becomes disengaged, and the stoppers 47 move under the urging force of the torsion springs 47T toward the second position shown in FIG. 4 and FIGS. 6 to 9.

When the motor M1 rotates backward, the one-way clutch 5C2 of the transmission mechanism 5 becomes engaged, and the stoppers 47 move under the driving force of the motor M1 toward the first position shown in FIGS. 1 to 3 and FIG. 5. In the present embodiment, the motor M1 is a stepping motor. The stoppers 47 at the first position are controlled by the controller 2 to be precisely held at predetermined positions, after the motor M1 rotates backward at a predetermined rotation angle and is held at the rotation angle while energized.

As shown in FIGS. 1 and 2, the transport rollers 44 are located downstream from the separation rollers 42 and the retard rollers 43 in the transport direction D1. Each transport roller 44 is rotatably supported by the support 50 with its outer circumferential surface partially exposed through the middle portion of the transport surface 55 in the front-rear direction. The transmission mechanism 5 transmits a driving force to the transport rollers 44 via the engaged one-way clutch 5C1.

As shown in FIG. 1, each transport pinch roller 44P is rotatably supported by the guide 60 with its outer circumferential surface partially exposed through the middle portion of the guide surface 65 in the front-rear direction. The transport pinch rollers 44P are pressed against the transport rollers 44 and are rotated by the rotation of the transport rollers 44.

As shown in FIGS. 1 and 2, the reading sensor 3A is assembled to the support 50 located downstream from the transport rollers 44 in the transport direction D1. Examples of the reading sensor 3A include a contact image sensor (CIS) and a charge coupled device (CCD). The reading surface of the reading sensor 3A facing upward defines the bottom of the transport path P1 together with the transport surface 55.

As shown in FIG. 1, the reading sensor 3B is assembled to the guide 60 located downstream from the transport pinch rollers 44P in the transport direction D1. The reading sensor 3B may be the same sensor as the reading sensor 3A. The reading surface of the reading sensor 3B facing downward defines the top of the transport path P1 together with the guide surface 65.

As shown in FIGS. 1 and 2, each discharge roller 45 is rotatably supported by the support 50 with its outer circumferential surface partially exposed through the front end of the transport surface 55. The transmission mechanism 5 transmits a driving force to the discharge rollers 45 via the engaged one-way clutch 5C1.

As shown in FIG. 1, each discharge pinch roller 45P is rotatably supported by the guide 60 with its outer circumferential surface partially exposed through the front end of the guide surface 65. The discharge pinch rollers 45P are pressed against the discharge rollers 45 and are rotated by the rotation of the discharge rollers 45.

Detailed Structures of Recess, Restrictor, and First Friction Member

As shown in FIGS. 1 to 3 and other drawings, the image reader 1 includes a recess 80, a restrictor 70, and a first friction member 91.

The support 50 has the recess 80 on the support surface 51. As shown in FIG. 2, the recess 80 is rectangular as viewed from above, and has its long sides extending in the transport direction D1 and extends along the center line C1. The recess 80 has a long side distance L70 substantially equal to the standardized long side length of the card CA (85.60 mm in the present embodiment). The recess 80 has a front short side substantially aligned with the support end 51E of the support surface 51 and extends in the left-right direction. The recess 80 has a short side length LW70 slightly greater than the standardized short side length of the card CA (53.98 mm in the present embodiment).

More specifically, the recess 80 is formed on the support surface 51 to conform to the outline of the card CA supported on the support surface 51 in portrait orientation, or with its long sides extending in the transport direction D1. As shown in FIGS. 5 to 9, the recess 80 having the short side length LW70 slightly greater than the standardized short side length of the card CA can receive the card CA.

As shown in FIGS. 2 and 3 and other drawings, the inner walls defining the recess 80 include a first inner wall 81, a second inner wall 82, and a third inner wall 83. The inner walls are immovable relative to the support surface.

The first inner wall 81 is a side surface located upstream from the other inner walls in the transport direction D1 and extending in the width direction, or a flat surface extending in the left-right direction along the rear short side of the recess 80 and facing downstream in the transport direction D1.

The second inner wall 82 defines the bottom of the recess 80. The rear end of the second inner wall 82 connects to the lower end of the first inner wall 81. The second inner wall 82 is a flat surface extending obliquely downward from the rear end downstream in the transport direction D1.

The third inner wall 83 is a side surface located downstream from the other inner walls in the transport direction D1 and extending in the width direction, or a flat surface extending in the left-right direction along the front short side of the recess 80 and facing upstream in the transport direction D1. The lower end of the third inner wall 83 connects to the front end of the second inner wall 82. The third inner wall 83 extends obliquely upward from the lower end to the front, and connects to the lower end of the slope 53 at a position substantially aligned with the support end 51E. The third inner wall 83 is flush with the slope 53.

The restrictor 70 is defined by the entire first inner wall 81. More specifically, as shown in FIG. 2, the length of the restrictor 70 in the left-right direction is the short side length LW70 of the recess 80. As shown in FIG. 3, the length LH70 of the restrictor 70 in the vertical direction is the length of the first inner wall 81 in the vertical direction. In the present embodiment, the length LH70 is slightly greater than the standardized thickness of the card CA (0.76 mm in the present embodiment) to prevent the restrictor 70 from interfering with sheets SH having other sizes.

As shown in FIG. 2, the distance by which the restrictor 70 is spaced upstream in the transport direction D1 from the support end 51E of the support surface 51 is the long side distance L70 of the recess 80. More specifically, the distance L70 is substantially equal to the standardized long side length of the card CA (85.60 mm in the present embodiment).

As shown in FIGS. 2 and 3 and other drawings, the first friction member 91 is located on the second inner wall 82. In the present embodiment, the first friction member 91 is a substantially rectangular plate formed from rubber or an elastomer. The first friction member 91 is located on the center line C1 and is adjacent to and downstream from the restrictor 70 in the transport direction D1. The first friction member 91 has a surface slightly raised from the second inner wall 82. The first friction member 91 may be a thin adhesive sheet including a frictional layer on its surface, and may be bonded to the second inner wall 82.

Image Reading Operation

When the image reader 1 with the above structure is powered on, the controller 2 determines whether any sheet SH or card CA is supported on the support surface 51 based on a detection signal from a sheet detector (not shown). When the controller 2 determines that a sheet SH or card CA is supported on the support surface 51, the controller 2 instructs a user to remove the sheet SH or card CA from the support surface 51. When the controller 2 determines that no sheets SH or cards CA are supported on the support surface 51, the controller 2 rotates the motor M1 backward at a predetermined rotation angle and retains the motor M1 energized at the rotation angle. The transmission mechanism 5 transmits a driving force to the stoppers 47 via the engaged one-way clutch 5C2. Thus, the stoppers 47 move to the first position shown in FIGS. 1 to 3 and FIG. 5 against the urging force of the torsion spring 47T. Moreover, the distal ends 47A of the stoppers 47 press the holder 49 upward to hold the feed rollers 41 above and apart from the support surface 51. This facilitates insertion of the ends of a plurality of sheets SH or cards CA into the housing 9 through the inlet 9H. The controller 2 places the image reader 1 in a standby status.

Referring now to FIG. 3, the user places sheets SH such as paper sheets or OHP sheets on the support surface 51 in the example described below. The controller 2 determines whether the user has placed the sheets SH based on a change in a detection signal from the sheet detector (not shown). In this state, the stopper surfaces 47B of the stoppers 47 held at the first position restrict the ends of the sheets SH supported on the support surface 51. This prevents misalignment of the ends of the sheets SH supported on the support surface 51.

In response to a command to perform the image reading operation, the controller 2 starts controlling the motor M1 and the reading sensors 3A and 3B. The controller 2 rotates the motor M1 forward. This disengages the one-way clutch 5C2 of the transmission mechanism 5 shown in FIG. 1. As shown in FIG. 4, the stoppers 47 urged by the torsion springs 47T move to the second position. This allows transportation of the sheets SH supported on the support surface 51. With the stoppers 47 located below and apart from the holder 49, the feed rollers 41 approach the support surface 51 and come into contact with the uppermost sheet SH among the sheets supported on the support surface 51. The transmission mechanism 5 transmits a driving force to the feed rollers 41, the separation rollers 42, the transport rollers 44, and the discharge rollers 45 via the engaged one-way clutch 5C1, thus rotating these rollers in the transport direction D1.

The feed rollers 41 then feed the sheets SH supported on the support surface 51 downstream in the transport direction D1 along the transport path P1. The fed sheets SH move up the slope 53 to the nip portion N1 between the separation roller 42 and the retard roller 43. In this state, the frictional resistance between the slope 53 and the sheets SH transported under the uppermost sheet SH prevents multiple stacked sheets SH from being collectively fed to the nip portion N1.

One or more sheets SH reaching the nip portion N1 are nipped by the separation rollers 42 and the retard rollers 43 and are transported downstream in the transport direction D1. When a single sheet SH reaches the nip portion N1, the retard rollers 43 are allowed to rotate by the torque limiter (not shown) and are rotated by the rotation of the separation rollers 42 in the transport direction D1 together with the sheet SH. When multiple sheets SH reach the nip portion N1, the retard rollers 43 are stopped by the torque limiter to generate a force to stop transporting sheets SH excluding the sheet SH touching the separation rollers 42.

As shown in FIG. 1, the transport rollers 44 and the transport pinch rollers 44P transport the sheets SH separated from one another toward the reading sensors 3A and 3B. The reading sensors 3A and 3B read an image of each sheet SH and transmit the image information to the controller 2. The discharge rollers 45 and the discharge pinch rollers 45P discharge the sheet SH to the discharge surface 6A of the discharge tray 6 after its image is read by the reading sensors 3A and 3B.

To end the image reading operation, the controller 2 rotates the motor M1 backward at a predetermined rotation angle. The stoppers 47 then move to the first position as shown in FIG. 1 to hold the feed rollers 41 above and apart from the support surface 51. The controller 2 places the image reader 1 in a standby status.

Referring now to FIG. 5, the user places the cards CA on the support surface 51 in portrait orientation in the example described below. The controller 2 determines whether the user has placed the cards CA based on a change in a detection signal from the sheet detector (not shown). In this state, the stopper surfaces 47B of the stoppers 47 held at the first position restrict the first ends CA1 of the cards CA supported on the support surface 51. This prevents misalignment of the leading ends of the cards CA supported on the support surface 51.

In this state, an upstream second end CA2 of the lowermost card CA among the cards supported on the support surface 51 is in the recess 80 and faces the restrictor 70. The lowermost card CA is directly supported on the support surface 51.

Figure 6:
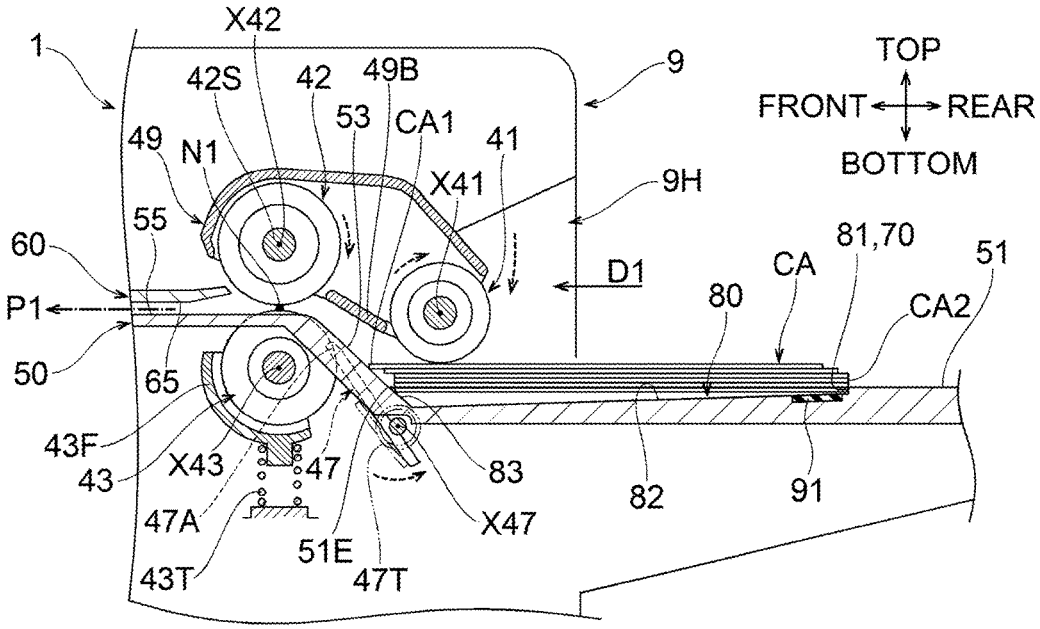
FIG. 6 is a schematic partial cross-sectional view of the image reader according to the first embodiment.

In response to a command to perform the image reading operation, the controller 2 starts controlling the motor M1 and the reading sensors 3A and 3B. As shown in FIG. 6, the stoppers 47 move to the second position, and the feed rollers 41 come into contact with the uppermost card CA supported on the support surface 51. When the feed rollers 41, the separation rollers 42, the transport rollers 44, and the discharge rollers 45 rotate in the transport direction D1 as shown in FIGS. 6 to 9, the a plurality of cards CA supported on the support surface 51 are sequentially transported along the transport path P1 and are then discharged to the discharge surface 6A after their images are read by the reading sensors 3A and 3B.

Effects

As shown in FIGS. 6 to 9, when the image reader 1 according to the first embodiment sequentially transports the a plurality of cards CA supported on the support surface 51, the first ends CA1 of the cards CA move up the slope 53 and the second ends CA2 of the cards CA slide on the second inner wall 82. Each card CA having high stiffness has an area between the first end CA1 and the second end CA2 located apart from the slope 53 and the second inner wall 82.

Figure 8:
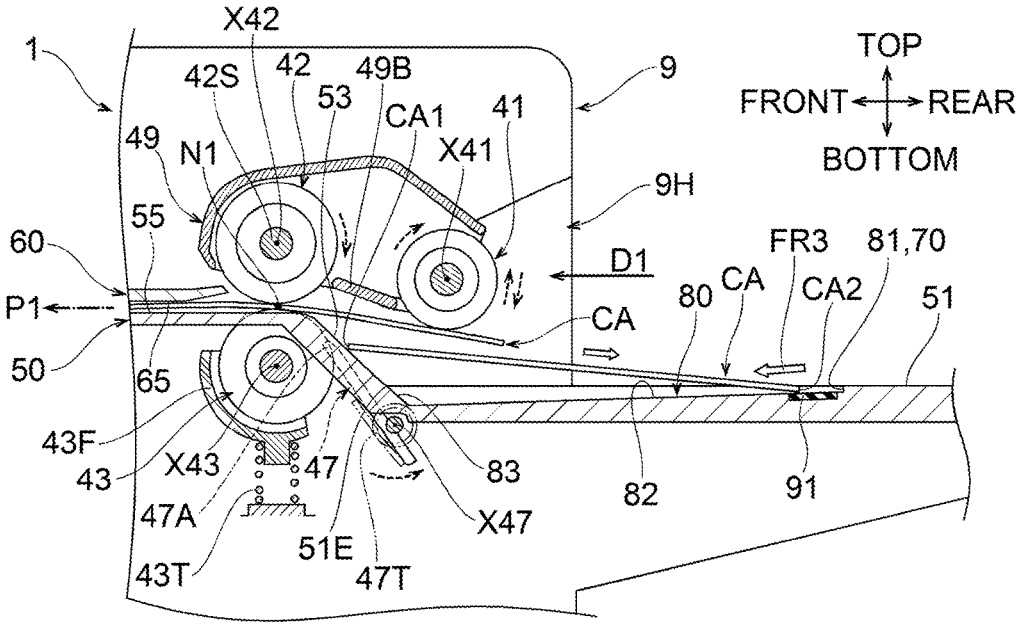
FIG. 8 is a schematic partial cross-sectional view of the image reader according to the first embodiment.

As shown in FIG. 8, the card CA that has moved up the slope 53 under the uppermost card CA has its first end CA1 sliding down the slope 53 by its weight, and then has its second end CA2 sliding back the second inner wall 82 upstream in the transport direction D1.

Figure 10:
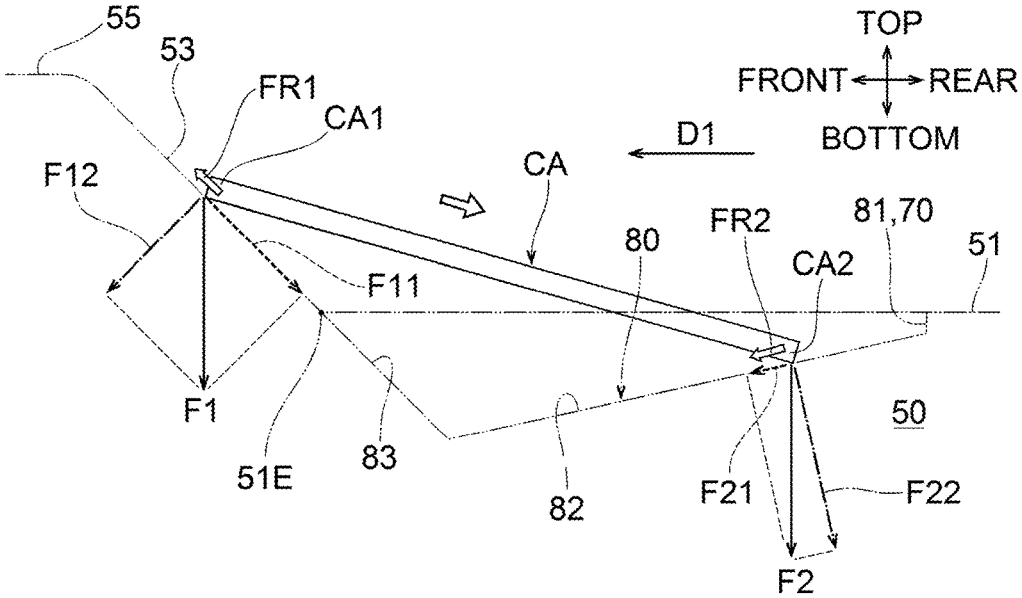
FIG. 10 is a schematic diagram showing forces acting on a card.

More specifically, as shown in FIG. 10, when each card CA has its first end CA1 in contact with the slope 53 and its second end CA2 in contact with the second inner wall 82, the weight of the card CA generates the first force F1 acting in the vertical direction on the first end CA1 and the second force F2 acting in the vertical direction on the second end CA2.

A component of force F11 of the first force F1 upstream in the transport direction D1 along the slope 53 acts on the card CA to return. In correspondence with a component of force F12 of the first force F1 perpendicular to the slope 53, a frictional resistance force FR1 opposite to the component of force F11 acts between the first end CA1 and the slope 53. The card CA formed from, for example, plastic is readily slidable along the slope 53 and has a small frictional resistance force FR1.

A component of force F21 of the second force F2 downstream in the transport direction D1 along the second inner wall 82 acts on the returning card CA to decelerate the card CA. In correspondence with a component of force F22 of the second force F2 perpendicular to the second inner wall 82, a frictional resistance force FR2 directed in the same direction as the component of force F21 acts between the second end CA2 and the second inner wall 82. The card CA formed from, for example, plastic is readily slidable over the second inner wall 82 and has a small frictional resistance force FR2.

As shown in FIG. 8, when the second end CA2 of the returning card CA slides on the surface of the first friction member 91, a frictional resistance force FR3 downstream in the transport direction D1 acts between the second end CA2 and the first friction member 91. The cards CA less easily slide on the first friction member 91 formed from, for example, rubber or an elastomer. The frictional resistance force FR3, which is greater than the frictional resistance forces FR1 and FR2, more reliably decelerates the card CA to return.

More specifically, the component of force F11 shown in FIG. 10 acts on the card CA that has moved up the slope 53 to return the card CA, the component of force F21 shown in FIG. 10 and the frictional resistance force FR3 shown in FIG. 8 act on the card CA to decelerate the card CA, and the frictional resistance forces FR1 and FR2 shown in FIG. 10 act on the card CA to slightly decelerate the card CA.

Figure 7:
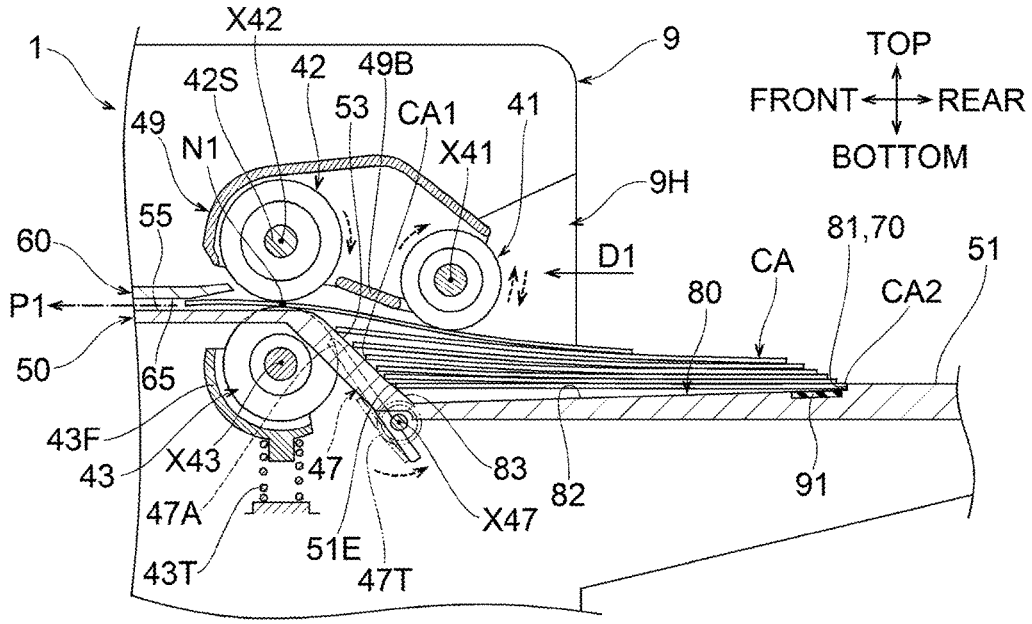
FIG. 7 is a schematic partial cross-sectional view of the image reader according to the first embodiment.
Figure 9:
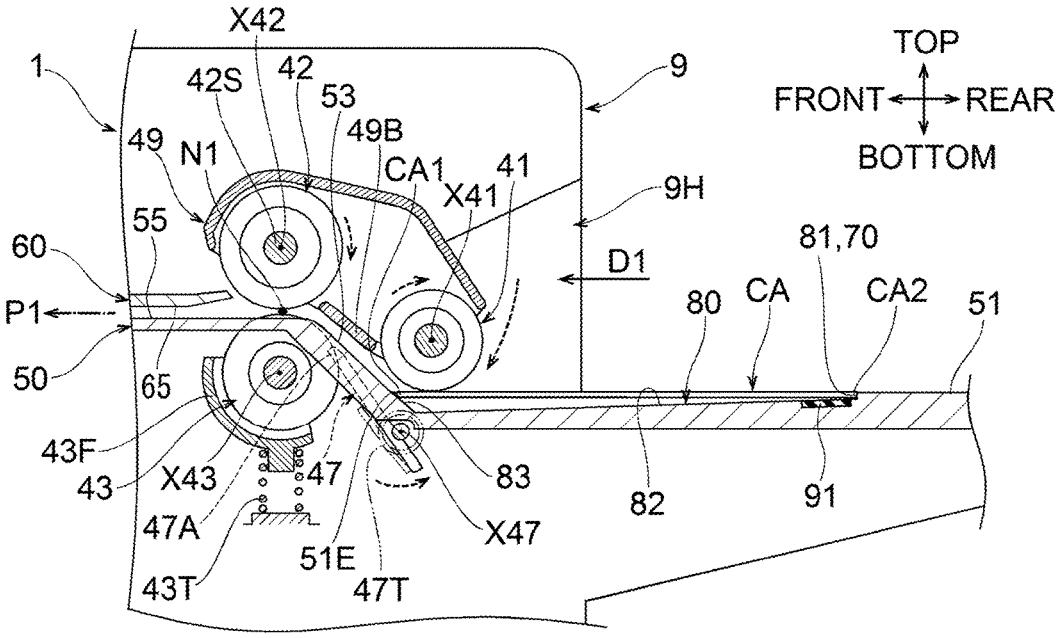
FIG. 9 is a schematic partial cross-sectional view of the image reader according to the first embodiment.

As shown in FIGS. 7 and 9, the lowermost card CA returning while being decelerated has its second end CA2 contacted and stopped by the restrictor 70. In this state, the restrictor 70, which is spaced from the support end 51E by the above distance L70, restricts the position of the second end CA2 for the first end CA1 to be downstream from the feed rollers 41 in the transport direction D1. This structure prevents the card CA from being misaligned upstream from the feed rollers 41 in the transport direction D1.

In the example shown in FIG. 9, the restrictor 70 restricts the position of the second end CA2 of the lowermost card CA returning alone. In the example shown in FIG. 7, the restrictor 70 restricts the position of the second end CA2 of the lowermost card CA returning under a plurality of cards CA. The cards CA stacked on the lowermost card CA are also prevented from being misaligned upstream in the transport direction D1 with the frictional resistance acting between the stacked cards CA and the lowermost card CA.

The image reader 1 according to the first embodiment transports one or more cards CA supported on the support surface 51, and prevents the feed rollers 41 from failing to feed the cards CA.

In the image reader 1, the support 50 includes the recess 80 formed on the support surface 51 to receive the card CA. The recess 80 is defined by inner walls including the first inner wall 81, which serves as the restrictor 70. This structure can reliably restrict the position of the second end CA2 of the card CA as shown in FIGS. 7 and 9 and other drawings. As shown in FIGS. 3 and 4, the restrictor 70 does not affect the sheets SH of other sizes.

In the image reader 1, as shown in FIG. 10 and other drawings, the recess 80 is defined by inner walls including the second inner wall 82, which extends obliquely downward downstream in the transport direction D1. This structure increases the component of force F21 acting on the second end CA2 of the returning card CA when the second end CA2 slides back the second inner wall 82. The component of force F21 can thus decelerate the card CA before the second end CA2 reaches the restrictor 70. This structure further prevents the card CA from being misaligned upstream from the feed rollers 41 in the transport direction D1.

In the image reader 1, as shown in FIG. 8 and other drawings, the first friction member 91 on the second inner wall 82 is located adjacent to and downstream from the restrictor 70 in the transport direction D1. This structure increases the frictional resistance force FR3 acting on the second end CA2 of the returning card CA when the second end CA2 slides on the surface of the first friction member 91. The frictional resistance force FR3 can thus decelerate the card CA before the second end CA2 reaches the restrictor 70. This structure further prevents the card CA from being misaligned upstream from the feed rollers 41 in the transport direction D1.

In the image reader 1, as shown in FIG. 9 and other drawings, the third inner wall 83 is flush with the slope 53. The first end CA1 of the card CA slides on the third inner wall 83 to the slope 53 without being caught, and then moves up the slope 53. This structure enables smooth transportation of the card CA.

In the image reader 1, as shown in FIG. 5, the card CA having its first end CA1 restricted by the stoppers 47 at the first position starts being transported without contact with the slope 53. The card CA is thus more likely to have a large reaction after moving up the slope 53, and is more likely to return upstream in the transport direction D1. In this state, the restrictor 70, the first friction member 91, and the second inner wall 82 prevent the card CA from being misaligned upstream from the feed rollers 41 in the transport direction D1.

In the image reader 1, as shown in FIG. 5, the distal ends 47A of the stoppers 47 that have moved to the first position press the holder 49 upward to move the feed rollers 41 upward apart from the support surface 51. This structure increases the maximum number of sheets SH that can be supported on the support surface 51, and increases the level difference between the upper end of the slope 53 and the support end 51E of the support surface 51. The card CA is thus more likely to have a large reaction after moving up the slope 53, and is more likely to return upstream in the transport direction D1. In this state, the restrictor 70, the first friction member 91, and the second inner wall 82 prevent the card CA from being misaligned upstream from the feed rollers 41 in the transport direction D1.

Second Embodiment

Figure 11:
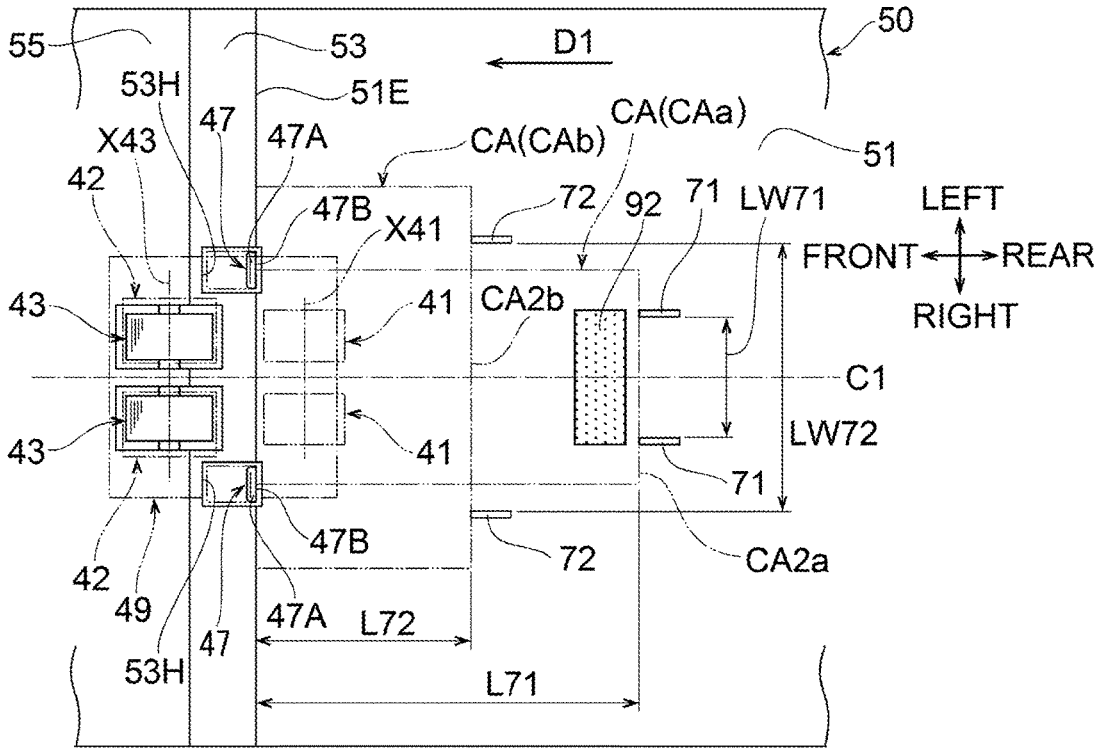
FIG. 11 is a schematic partial top view of an image reader according to a second embodiment.
Figure 12:
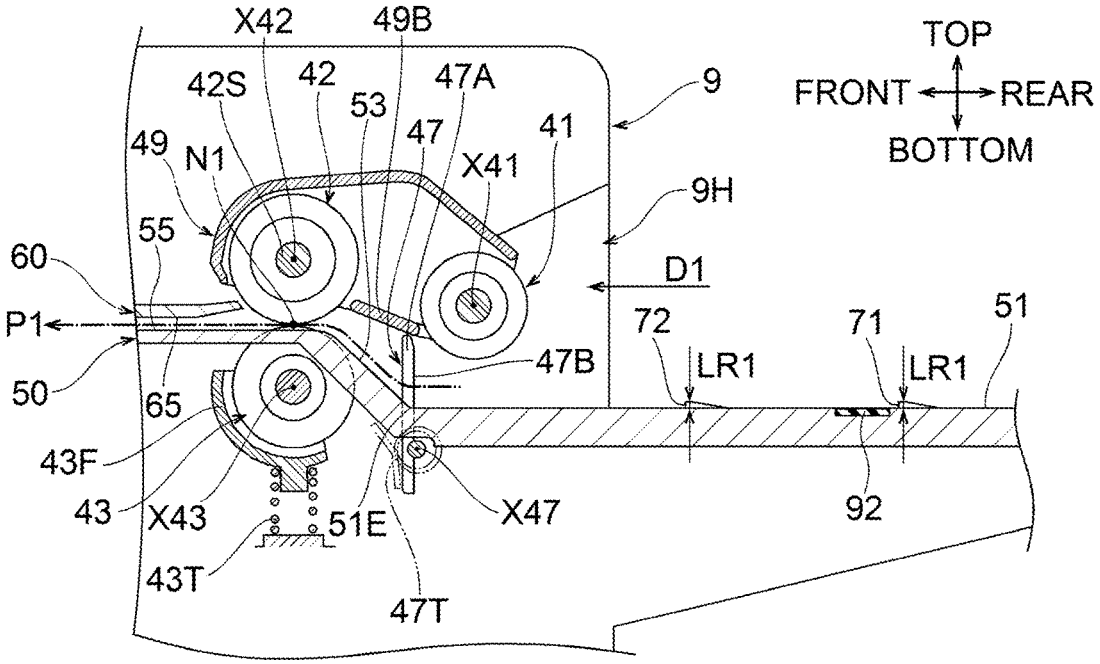
FIG. 12 is a schematic partial cross-sectional view of the image reader according to the second embodiment.
Figure 13:
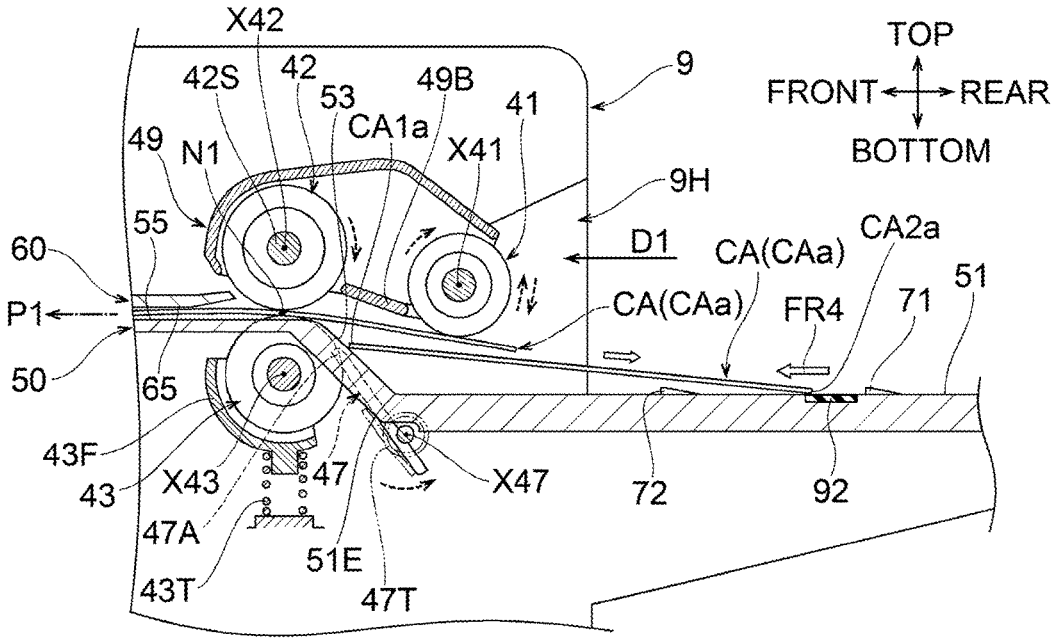
FIG. 13 is a schematic partial cross-sectional view of the image reader according to the second embodiment.
Figure 14:
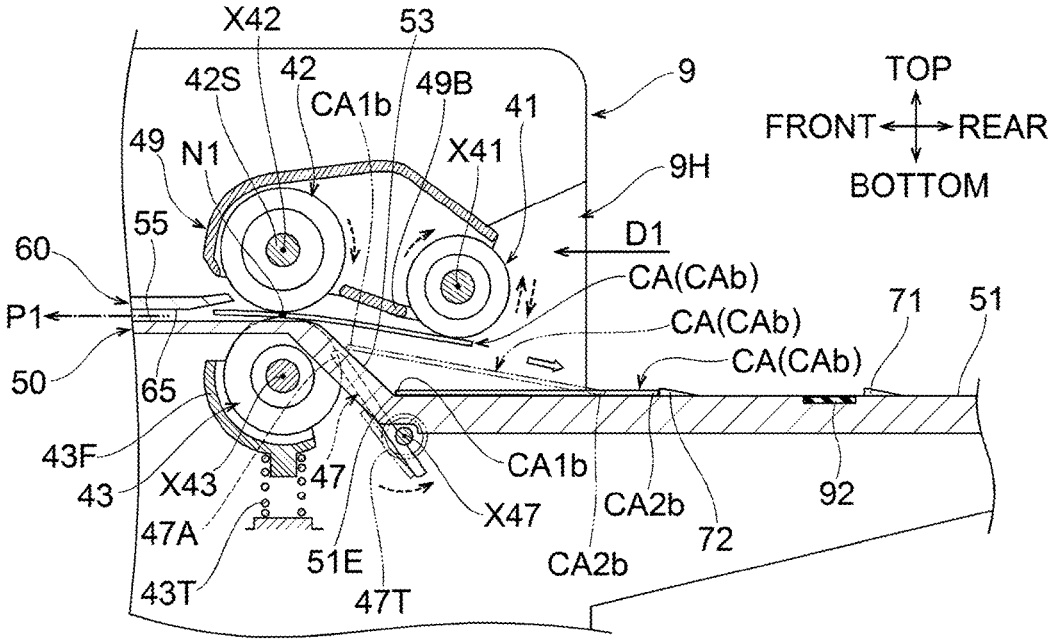
FIG. 14 is a schematic partial cross-sectional view of the image reader according to the second embodiment.

As shown in FIGS. 11 and 12, an image reader according to a second embodiment includes a support surface 51 eliminating the recess 80, the restrictor 70, and the first friction member 91 of the image reader 1 according to the first embodiment, and instead including first restrictors 71, second restrictors 72, and a second friction member 92. The first restrictors 71 and the second restrictors 72 each are an example of a restrictor according to an aspect of the disclosure. As shown in FIGS. 11, 13, and 14 in the second embodiment, the support surface 51 is designed to support the card CA in portrait orientation (CAa hereafter) and the card CA in landscape orientation (Cab hereafter), or with its short sides extending in the transport direction D1. The other components of the second embodiment are the same as those described in the first embodiment. The components that are the same as those described in the first embodiment are given the same reference numerals, and will not be described or will be described briefly.

As shown in FIGS. 11 and 12, the first restrictors 71 and the second restrictors 72 are ribs protruding from the support surface 51. The first restrictors 71 and the second restrictors 72 are immovable relative o to the support surface 51. As shown in FIG. 12, the first restrictors 71 and the second restrictors 72 have the same shape when viewed laterally. The first restrictors 71 and the second restrictors 72 protrude from the support surface 51 by a protruding length LR1 increasing from upstream to downstream in the transport direction D1, thereby having their protruding end extending obliquely relative to the support surface 51. The protruding length LR1 is greater than the standardized thickness of the card CA (0.76 mm in the present embodiment), and smaller than twice the standardized thickness. The first restrictors 71 and the second restrictors 72 each have a front edge vertically extending perpendicular to the support surface 51.

As shown in FIG. 11, the first restrictors 71 are arranged at two positions apart from each other in the left-right direction across the center line C1. A distance L71 by which each first restrictor 71 is spaced upstream in the transport direction D1 from the support end 51E of the support surface 51 is substantially the same as the standardized long side length of the card CAa in portrait orientation (85.60 mm in the present embodiment).

A distance LW71 between the left and right first restrictors 71 is shorter than the standardized short side length of the card CAa in portrait orientation (53.98 mm in the present embodiment).

The second restrictors 72 are arranged at two positions apart from each other in the left-right direction across the center line C1. A distance L72 by which each second restrictor 72 is spaced upstream in the transport direction D1 from the support end 51E of the support surface 51 is substantially the same as the standardized short side length of the card CAb in landscape orientation (53.98 mm in the present embodiment).

A distance LW72 between the left and right second restrictors 72 is shorter than the standardized long side length of the card CAb in landscape orientation (85.60 mm in the present embodiment).

As shown in FIGS. 11 and 12, the second friction member 92 is located on the support surface 51. The second friction member 92 is formed from the same material as for the first friction member 91 according to the first embodiment. The second friction member 92 is located on the center line C1 and adjacent to and downstream from the first restrictors 71 in the transport direction D1. The second friction member 92 has a surface slightly raised from the support surface 51.

As shown in FIG. 13, when the image reader according to the second embodiment with the above structure sequentially transports a plurality of cards CAa supported in portrait orientation on the support surface 51, the lowermost card CAa, which is directly supported on the support surface 51, has its first end CA1*a* downstream in the transport direction D1 moving up the slope 53, and its second end CA2*a* upstream in the transport direction D1 sliding on the support surface 51. The lowermost card CAa that has moved up the slope 53 under the uppermost card CAa has its first end CA1*a* sliding down the slope 53 by its weight, and then has its second end CA2*a* sliding back the support surface 51 upstream in the transport direction D1.

When the second end CA2*a* of the returning card CAa slides back the surface of the second friction member 92, a frictional resistance force FR4 downstream in the transport direction D1 acts between the second end CA2*a* and the second friction member 92. The frictional resistance force FR4 can highly reliably decelerate the returning card CA before the card CA reaches the first restrictors 71.

Although not shown, the second end CA2*a* of the card CAa returning while being decelerated contacts and is stopped by the first restrictors 71. In this state, the first restrictors 71, which are spaced apart from the support end 51E by the above distance L71, restrict the position of the second end CA2*a* for the first end CA1*a* to be downstream from the feed rollers 41 in the transport direction D1. This prevents the card CAa in portrait orientation from being misaligned upstream from the feed rollers 41 in the transport direction D1.

As shown in FIG. 14, when the a plurality of cards CAb supported in landscape orientation on the support surface 51 are sequentially transported, the first end CA1*b* of the lowermost card CAb downstream in the transport direction D1 moves up the slope 53 and the second end CA2*b* of the lowermost card CAb upstream in the transport direction D1 slides on the support surface 51. As shown in FIG. 14 with a two-dot chain line, the lowermost card CAb that has moved up the slope 53 under the uppermost card CAb has its first end CA1*b* sliding down the slope 53 by its weight, and then has its second end CA2*b* sliding back the support surface 51 upstream in the transport direction D1.

As shown in FIG. 14 with a solid line, the returning card CAb has its second end CA2*b* contacted and stopped by the second restrictors 72. The second restrictors 72, which are spaced apart from the support end 51E by the distance L72, restrict the position of the second end CA2*b* to allow the first end CA1*b* to be downstream from the feed rollers 41 in the transport direction D1. This prevents the card CAb in landscape orientation from being misaligned upstream from the feed rollers 41 in the transport direction D1.

When the image reader according to the second embodiment sequentially transports the cards CAa supported in portrait orientation on the support surface 51, and sequentially transports the cards CAb supported in landscape orientation on the support surface 51, the feed rollers 41 are prevented from failing to feed the cards CAa and CAb.

As shown in FIG. 12 and other drawings, the first restrictors 71 and the second restrictors 72 in this image reader are ribs protruding from the support surface 51 and can easily be formed.

As shown in FIG. 12 and other drawings, the first restrictors 71 and the second restrictors 72 in this image reader each extend obliquely to have a protruding length LR1, by which each restrictor protrudes from the support surface 51. The protruding length LR1 increases from upstream to downstream in the transport direction D1. Thus, the ends of the sheets SH of other sizes are less likely to be caught on the first restrictors 71 and the second restrictors 72. The first restrictors 71 can thus restrict the positions of the second ends CA2*a* of the cards CAa in portrait orientation without affecting the sheets SH of other sizes. The second restrictors 72 can restrict the second ends CA2*a* in the same manner as the first restrictors 71.

In the image reader, as shown in FIG. 12, the protruding length LR1 of the first restrictors 71 and the second restrictors 72 is greater than the standardized thickness of the card CA (0.76 mm in the present embodiment) and smaller than twice the standardized thickness. As shown in FIG. 13, the first restrictors 71 can restrict the position of the second end CA2*a* of the lowermost card CAa among the plurality of cards CAa supported in portrait orientation on the support surface 51, and prevents the lowermost card CAa from being misaligned upstream from the feed rollers 41 in the transport direction D1. The cards CAa stacked on the lowermost card CAa are prevented from being misaligned upstream in the transport direction D1 with the frictional resistance acting between the lowermost card CAa and the cards CAa stacked on the lowermost card CAa. The second restrictors 72 can restrict the second end CA2*a* in the same manner as the first restrictors 71. The first restrictors 71 and the second restrictors 72 having a relatively small protruding length LR1 are less likely to affect the sheets SH of other sizes.

The present invention has been described based on the first and second embodiments, but is not limited to these embodiments, and may be modified freely without departing from the spirit and scope of the disclosure.

The feed rollers 41 serve as a feed unit in the first and second embodiments. In some embodiments, an endless belt may serve as the feed unit.

The separation rollers 42 and the retard rollers 43 serve as a separator in the first and second embodiments. In some embodiments, the separator may include separation pads instead of the retard rollers.

The distances L70 and L71 are substantially equal to the standardized long side length of the card CA in the above embodiments. In some embodiments, the distances L70 and L71 may be longer than the standardized long side length of the card CA within the range that allows the first end CA1 of the card CA to be downstream from the feed rollers 41 in the transport direction D1. The same applies to the distance L72.

The support surface 51 may include side guides that slide in the left-right direction to align the sheets SH in the width direction. The side guides are shaped to avoid interference with the restrictor 70, the first and second restrictors 71 and 72, and the recess 80.

What is claimed is:

1. A card transport device, comprising:

a support surface configured to support one or more cards thereon;

a feed unit facing the support surface, and configured to feed the one or more cards supported on the support surface downstream in a transport direction along a transport path;

a separator located downstream from the feed unit in the transport direction, and configured to transport the cards fed by the feed unit downstream in the transport direction while separating the cards from one another;

a slope connected to a downstream support end of the support surface in the transport direction and extending obliquely upward downstream in the transport direction toward the separator; and a restrictor located on the support surface, and configured to restrict a position of an upstream end in the transport direction of a particular card directly supported on the support surface, out of the one or more cards, thereby positioning a downstream end of the particular card to be downstream from the feed unit in the transport direction, wherein the restrictor is immovable relative to the support surface and has a receiving surface configured to receive the upstream end of the particular card.

2. The card transport device according to claim 1, wherein the restrictor is spaced upstream in the transport direction from the downstream support end of the support surface by a distance which is substantially equal to a card length standardized by ISO/IEC 7810 ID-1.

3. The card transport device according to claim 1, wherein:

the support surface has a recess conforming to an outline of each of the one or more cards, and the restrictor includes a first inner wall included in inner walls defining the recess, and the first inner wall is located upstream from the other inner walls in the transport direction and extends in a width direction perpendicular to the transport direction.

4. The card transport device according to claim 3, wherein the inner walls defining the recess include a second inner wall defining a bottom of the recess, and the second inner wall extends obliquely downward and downstream in the transport direction.

5. The card transport device according to claim 3, further comprising a friction member located on a second inner wall included in the inner walls and defining a bottom of the recess, the friction member being adjacent to and downstream from the restrictor in the transport direction.

6. The card transport device according to claim 3, wherein the inner walls defining the recess include a third inner wall located downstream from the other inner walls in the transport direction, and the third inner wall extends in the width direction and is flush with the slope.

7. The card transport device according to claim 1, wherein the restrictor includes a rib protruding from the support surface.

8. The card transport device according to claim 7, wherein the restrictor protrudes from the support surface by a protruding length which increases from upstream to downstream in the transport direction, a protruding end of the restrictor extending obliquely relative to the support surface.

9. The card transport device according to claim 8, wherein the protruding length is greater than a card thickness standardized by ISO/IEC 7810 and smaller than twice the standardized card thickness.

10. The card transport device according to claim 7, further comprising a friction member located on the support surface, the friction member being adjacent to and downstream from the restrictor in the transport direction.

11. The card transport device according to claim 1, further comprising a stopper movable between a first position at which the stopper intersects at least one of the support surface and the slope to restrict downstream ends in the transport direction of the one or more cards supported on the support surface, and a second position at which the stopper is withdrawn from the at least one of the support surface and the slope to allow transportation of the one or more cards.

12. The card transport device according to claim 11, wherein:

the feed unit includes a feed roller configured to rotate about a first axis extending in a width direction perpendicular to the transport direction, the separator includes a separation roller configured to rotate about a second axis parallel to the first axis, the card transport device further includes a holder supported to be swingable about the second axis and holding the feed roller rotatably about the first axis, and the stopper has an upper end configured to contact and move the holder away from the support surface in response to the stopper moving from the second position to the first position.

13. The card transport device according to claim 1, wherein the restrictor includes:

a first restricting member configured to restrict a short side at the upstream end of the particular card when the particular card is directly supported on the support surface with a long side thereof extending parallel to the transport direction, and a second restricting member configured to restrict a long side at the upstream end of the particular card when the particular card is directly supported on the support surface with a short side thereof extending parallel to the transport direction.

14. The card transport device according to claim 1, further comprising a reader located downstream from the separator in the transport direction, and configured to read an image of the one or more cards transported along the transport path.

15. The card transport device according to claim 1, wherein the receiving surface of the restrictor extends by a predetermined length in the direction perpendicular to the transport direction and away from the support surface, the predetermined length being greater than a card thickness standardized by ISO/IEC7810 and smaller than twice the standardized card thickness.

16. The card transport device according to claim 1, wherein the support surface extends substantially horizontally.

17. The card transport device according to claim 1, wherein the one or more cards supported on the support surface are made of plastic.

* * * * *